US005673829A

United States Patent [19]

Hartshorn

[11] Patent Number: 5,673,829

[45] Date of Patent: Oct. 7, 1997

[54] CARRIER APPARATUS FOR CONTAINERS AND SMALL OBJECTS

[76] Inventor: Gordon K. Hartshorn, 5454 Magnolia Dr., Nederland, Colo. 80466

[21] Appl. No.: 563,571

[22] Filed: Nov. 28, 1995

Related U.S. Application Data

[60] Provisional application No. 60/000,121, Jun. 9, 1995.

[51] Int. Cl. [6] ..... A45F 5/00

[52] U.S. Cl. ..... 224/256; 24/16 PB; 24/30.5 P; 224/251; 224/908

[58] Field of Search ..... 224/255, 256, 224/251, 674, 675, 908; 24/16 PB, 30.5 P; 248/311.2, 312, 315

[56] References Cited

U.S. PATENT DOCUMENTS

| | | | |
|---|---|---|---|
| 782,357 | 2/1905 | Pogue . | |
| 876,402 | 1/1908 | Schacht | 24/16 PB |
| 2,545,428 | 3/1951 | Liautaud | 24/30.5 P |
| 4,001,919 | 1/1977 | Moberg et al. | 24/16 PB |
| 4,180,192 | 12/1979 | Breslau . | |
| 4,406,385 | 9/1983 | Pribyl . | |
| 4,558,495 | 12/1985 | Olsen | 24/298 |
| 4,631,783 | 12/1986 | Hayashi | 24/16 PB |
| 4,801,011 | 1/1989 | Desdoiguts et al. . | |
| 5,065,918 | 11/1991 | Chun et al. . | |
| 5,172,838 | 12/1992 | Rowell et al. . | |
| 5,295,578 | 3/1994 | Neidospial, Jr. et al. . | |
| 5,402,971 | 4/1995 | Bower | 24/16 PB |
| 5,531,733 | 7/1996 | Scarrow | 24/16 PB |

*Primary Examiner*—Henry J. Recla
*Assistant Examiner*—Charles R. Eloshway
*Attorney, Agent, or Firm*—John R. Wahl; Holland & Hart LLP

[57] ABSTRACT

A carrier apparatus for holding an object such as a film canister is disclosed. The carrier comprises a flexible elastic body having a ring portion adapted to receive and hold the object therein, an eyelet portion having an aperture therethrough and an elongated flexible tail portion. The tail portion has a free end and a plurality of linearly spaced enlarged nodules thereon. The tail portion is sized to pass through the aperture in the eyelet portion. The nodules are sized to elastically deform and frictionally pass through the aperture in said eyelet portion when the tail portion is pulled through the aperture. In use, the free end of the tail portion may be bent around a support structure such as through a button hole and passed through the aperture through the eyelet portion. Then the free end is grasped and at least one of the nodules is pulled through the aperture to frictionally capture a portion of the tail portion between adjacent nodules in the eyelet portion, forming a fastening loop around the support structure. A container or other object is then frictionally slipped into and held in place by the ring portion of the apparatus.

20 Claims, 1 Drawing Sheet

CARRIER APPARATUS FOR CONTAINERS AND SMALL OBJECTS

CROSS REFERENCE TO RELATED APPLICATIONS

This application claims the benefit of U.S. provisional patent application Ser. No. 60/000,121, filed Jun. 9, 1995.

BACKGROUND OF THE INVENTION

1. Field of the Invention

This invention relates generally to carriers devices and more particularly to a ring shaped carrier adapted to hold small articles or containers which can be removably attached to clothing, a camera strap or the like.

2. Description of the Related Art

Carriers or holsters for hand held objects which are designed for fastening to a belt are generally well known. One example of such a carrier for an umbrella is disclosed in U.S. Pat. No. 782,357.

Accessory carriers for small objects such as photographic film have also been developed which attach to the camera strap of a camera bag. For example, U.S. Pat. No. 5,172,838 discloses a camera strap which includes expandable loops for holding film canisters. U.S. Pat. No. 5,065,918 discloses a snap fit film canister holder which has a spring clip to fasten the holder to the hand strap of a camera. U.S. Pat. No. 4,180,192 discloses a film canister dispenser that can be attached to a strap or a wearer's belt. Finally, U.S. Pat. No. 4,406,385 discloses a film canister which has an integral strap clip for fastening the canister to a camera strap.

However, there remains a need for a versatile, simple, inexpensive carrier for small containers such as film canisters and other small objects such as a compass which can be conveniently attached to the exterior of an article of clothing, a backpack ring or strap or other equipment for instant access rather than keeping the container or object buried in a pocket, pouch or pack. Such a carrier needs to be light, quickly attachable and detachable, and reusable.

SUMMARY OF THE INVENTION

The present invention is directed to meeting the above identified needs. The carrier apparatus in accordance with the present invention is a simple, injection molded plastic or rubber device which includes a flexible elastic body having a ring portion adapted to receive and hold an object such as a film canister therein, an eyelet portion which has an aperture therethrough and an elongated flexible tail portion which has a free end and a plurality of linearly spaced nodules thereon. The free end of the tail portion is sized to pass through the aperture in the eyelet portion. The nodules, on the other hand, are sized not to freely pass through the aperture but are sized to elastically deform and frictionally pass through the aperture in the eyelet portion when the tail portion is forcibly pulled through the aperture.

To use the carrier in accordance with the invention, the ring portion is first stretched around the object to be carried. The free end of the tail portion is then passed through a button hole, around a belt loop, around a strap, or through a ring on a strap attachment or around any item to which the carrier is to be attached. The free end is then passed through the aperture in the eyelet portion. The protruding free end is then grasped and at least one of the nodules is pulled through the aperture to frictionally retain that part of the tail portion which is between adjacent nodules in the eyelet portion. The amount of the tail portion pulled through the aperture determines the size of the fastening loop formed in the tail portion and can be easily changed.

These and other objects, features and advantages of the carrier apparatus of the present invention will become more apparent from a reading of the following detailed description when taken in conjunction with the accompanying drawing.

DETAILED DESCRIPTION OF THE INVENTION

Figure 1:
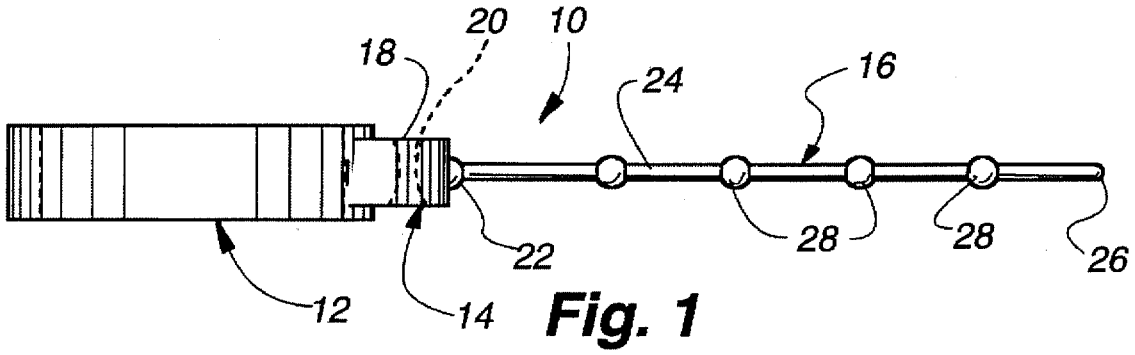
FIG. 1 is a side view of a carrier apparatus in accordance with the present invention.
Figure 2:
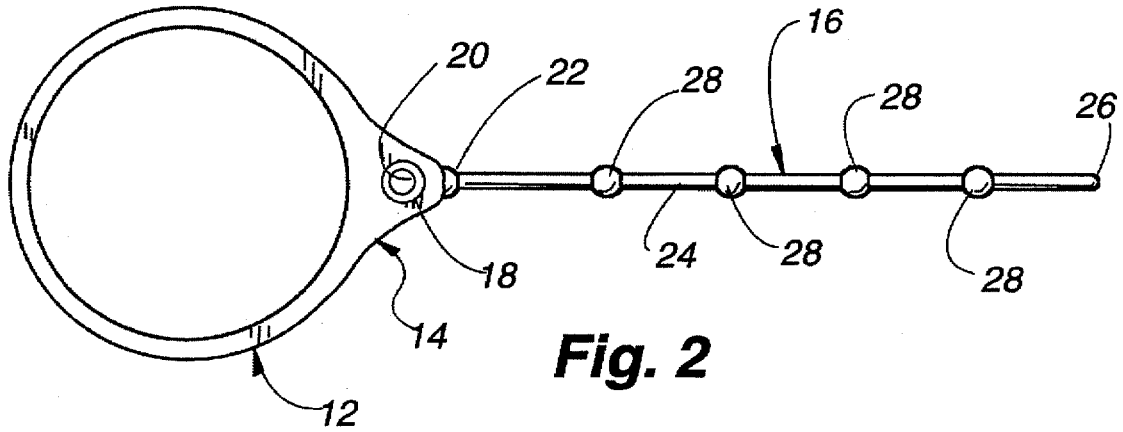
FIG. 2 is a plan view of the carrier apparatus in accordance with the present invention.

Referring now to the drawing, a side view of a first embodiment of the carrier of the invention is shown in FIG. 1 and a plan view in FIG. 2. The carrier 10 is a one piece, unitary body having a hoop or ring portion 12, an eyelet portion 14, and an elongated tail portion 16. The carrier 10 is preferably injection molded from a thermoplastic elastomer that is flexible, stretchable and has a high degree of elasticity. For example, Rimflex A/HS-1C may be used to injection mold the carrier apparatus in accordance with the invention.

The ring portion 12 is preferably a short cylindrical tube sized to stretch to fit around the object to be carried, such as a 35 mm film cartridge canister. For this particular purpose, only as an example, the ring portion may be about ⅜ inch in length, preferably has an inside diameter of about ⅗ inch and preferably an outside diameter of about 7/10 inch. Other lengths and diameters may be used depending on the size of the object intended to be carried. The example of a film canister will be used herein for illustrative purposes only. The ring portion 12 may also be other than cylindrical such as square, rectangular, octagonal, etc. depending on the shape of the carried object. However, the ring portion 12 should have some elasticity so that it can be stretched to frictionally fit around the object to ensure a secure hold on it.

The eyelet portion 14 is a boss-like enlarged or thickened region at one location on the perimeter of the ring portion 12 which connects the tail portion 16 to the ring portion 12. The eyelet portion 14 has a central aperture 18 therethrough which is a bore having a central axis parallel to that of the ring portion 12. This bore 18 preferably has the shape of a convergent/divergent nozzle with a constricting throat 20.

Figure 3:
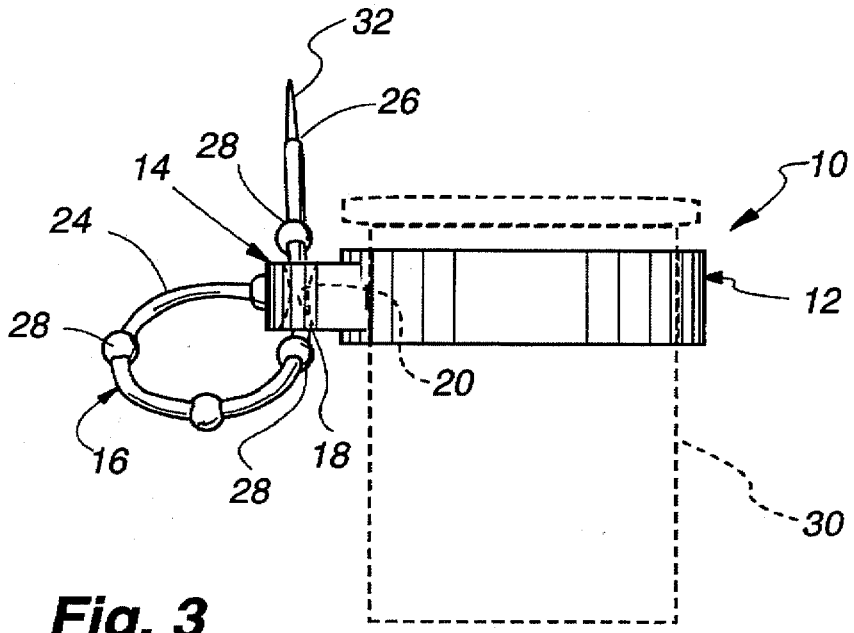
FIG. 3 is a side view of the apparatus shown in FIG. 1 with the tail portion inserted through the constricting aperture in the ring shaped body and a film canister shown in phantom installed in the carrier.

The eyelet portion 14 preferably tapers to a base end 22 of the tail portion 16 to provide sufficient support for the tail portion 16. The tail portion 16 is a relatively thin cylindrical rod 24 which may have a diameter of about 1/10 inch and a length of about 3 inches, The diameter is preferably chosen to be close to that of the throat 20 of the aperture 18 so that the free end 26 of the tail portion 16 can be easily but preferably frictionally threaded through the aperture 18 as is shown in FIG. 3. However, the length may be any desired length and it may be substantially longer than 3 inches so that the user can cut the tail portion to any desired length for his or her particular use.

Spaced along the rod 24 of the tail portion 16 are a plurality of enlarged nodules 28. These nodules are typically spaced about % inch apart. These nodules each preferably has an outer diameter slightly larger than that of the throat 20 of the aperture 18 and smaller than the entrance to the aperture 18 so that when the free end 26 of the tail portion 16 is threaded through the aperture 18 and pulled, the nodules may each be sequentially elastically deformed so as to frictionally pass through the throat of the aperture 18. Typically, it is necessary only to pull the first or second nodule 28 through the aperture 18 in order to secure the free end 26 of the tail portion 16 around any conceivable support structure, such as a wearer's belt loop, and to the eyelet portion 14 as is shown in FIG. 3.

In FIG. 3, the ring portion 12 of the carrier apparatus 10 is applied to a 35 mm film canister 30, shown in dotted lines. The tail portion 16 is envisioned as passing though a wearer's buttonhole or belt loop (not shown). In addition, the tail portion 16 here includes a thin extension 32 which extends from the free end 26. This extension 32 may be optionally provided to facilitate threading the free end 26 through the aperture 18. The extension 32 and the free end 26 may then be readily grasped to pull the nodule 28 through the narrow throat 20 of the aperture 18 to capture the rod 24 of the tail portion 16 in the aperture 18.

The tail portion 16 can be easily removed from the aperture 18 by grasping the loop so formed and pulling the nodules 28 and the free end 26 out through the aperture 18. The free end 26 and the extension 32 may be inserted through the aperture 18 in either direction, either from the bottom as shown in FIG. 3 or from the top, opposite to that shown in FIG. 3.

While the carrier apparatus in accordance with the present invention has been shown and described with reference to particular embodiments thereof, it is to be understood that the invention may be practiced other than as specifically described. For example, the particular embodiments shown include 4 spaced nodules 28. There may be more or less nodules provided and the length of the tail portion 16 may be other than as shown. The nodules 28 are preferably spherical in shape, but may be other shapes as well. The size and shape of the ring portion 12 may also be other than a short cylindrical tube. Also, more than one eyelet portion 14 and tail portion 16 may be provided, spaced around the ring portion 12. Accordingly, it is intended that the invention embrace all such variations, modifications, and alterations.. All patents, patent applications, and other publications cited herein are incorporated by reference herein in their entirety.

What is claimed is:

1. A carrier apparatus for holding an object comprising:

a flexible elastic body having a stretchable ring portion adapted to receive and hold said object therein, an eyelet portion having an aperture therethrough and an elongated flexible and stretchable tail portion, said tail portion having a free end and a plurality of linearly spaced nodules thereon wherein said tail portion is sized to removably pass through said aperture in said eyelet portion and said nodules are sized to elastically deform and frictionally pass through said aperture in said eyelet portion when a portion of said tail portion is stretched and pulled through said aperture, whereby said free end of said tail portion may be bent around a support structure and passed through said aperture and at least one of said nodules pulled through said aperture to frictionally retain a portion of said tail portion in said eyelet portion.

2. The apparatus according to claim 1 wherein said tail portion is sized to frictionally pass through said aperture in said eyelet portion.

3. The apparatus according to claim 1 wherein said aperture has a convergent/divergent nozzle shape.

4. The apparatus according to claim 1 wherein said tail portion has a thin elongated tip for free passage through said aperture through said eyelet portion.

5. The apparatus according to claim 4 wherein said tail portion has four spaced nodules.

6. The apparatus according to claim 1 wherein said ring portion is sized to frictionally receive a film canister.

7. The apparatus according to claim 6 wherein said ring portion has a short cylindrical tubular shape.

8. The apparatus according to claim 7 wherein said body is a one piece injection molded body of thermoplastic material.

9. The apparatus according to claim 1 wherein said body is made of a thermoplastic elastomer.

10. A carrier apparatus for holding an object comprising:

a flexible elastomeric body having a stretchable ring portion adapted to receive and hold said object therein, an eyelet portion having a convergent/divergent nozzle shaped aperture therethrough and an elongated flexible tail portion, said tail portion having a free end and a plurality of linearly spaced generally spherically shaped nodules thereon wherein said tail portion is sized to removably pass through said aperture in said eyelet portion and said nodules are sized to elastically deform and frictionally pass through said aperture in said eyelet portion when said tail portion is pulled through said aperture, whereby said free end of said tail portion may be bent around a support structure and passed through said aperture and at least one of said nodules pulled through said aperture to frictionally removably retain a portion of said tail portion in said eyelet portion thereby removably fastening said carrier to said support structure.

11. The apparatus according to claim 10 wherein said tail portion has a diameter sized to frictionally pass through said aperture in said eyelet portion.

12. The apparatus according to claim 10 wherein said tail portion has a thin elongated tip for free passage of said tip through said aperture through said eyelet portion.

13. The apparatus according to claim 12 wherein said tail portion has four spaced nodules.

14. The apparatus according to claim 13 wherein said ring portion has a short cylindrical tubular shape.

15. The apparatus according to claim 10 wherein said ring portion is sized to frictionally receive a film canister.

16. A carrier apparatus for holding an object comprising:

a flexible elastic body having a stretchable ring portion adapted to receive and hold an object therein;

an eyelet portion having an aperture therethrough; and an elongated flexible and stretchable tail portion;

said tail portion having a free end and a plurality of linearly spaced generally spherically shaped nodules thereon wherein said nodules are elastically deformable and sized effective to frictionally pass through said aperture in said eyelet portion and removably hold a portion of said tail portion in said aperture when a portion of said tail portion including at least one of said nodules is stretched and pulled through said aperture.

17. The apparatus according to claim 16 wherein said free end has a thin elongated tip sized to freely pass through said aperture through said eyelet portion.

18. The apparatus according to claim 16 wherein said ring portion has a short cylindrical tubular shape.

19. The apparatus according to claim 16 wherein said aperture has a convergent/divergent cross sectional shape.

20. The apparatus according to claim 19 wherein said tail portion has a diameter sized to frictionally pass through said aperture in said eyelet portion.

* * * * *